US008345907B2

(12) United States Patent
Giese et al.

(10) Patent No.: US 8,345,907 B2
(45) Date of Patent: Jan. 1, 2013

(54) HEARING DEVICE WITH MECHANICAL ADJUSTMENT OF SOUND PROPERTIES

(75) Inventors: Ulrich Giese, Fürth (DE); Silke Gürtler, Uttenreuth (DE); Stefan Kexel, Altdorf (DE); Nadine Seubert, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 154 days.

(21) Appl. No.: 12/964,078

(22) Filed: Dec. 9, 2010

(65) Prior Publication Data

US 2011/0135132 A1 Jun. 9, 2011

(30) Foreign Application Priority Data

Dec. 9, 2009 (DE) ..... 10 2009 057 581

(51) Int. Cl.
*H04R 25/00* (2006.01)

(52) U.S. Cl. ..... 381/328; 381/322; 381/329

(58) Field of Classification Search ..... 381/329, 381/328, 324, 322, 380, 381, 382, 64
See application file for complete search history.

(56) References Cited

U.S. PATENT DOCUMENTS

| | | | | |
|---|---|---|---|---|
| 5,701,348 | A | 12/1997 | Shennib et al. | |
| 7,508,951 | B2 * | 3/2009 | Bordewijk | 381/329 |
| 2009/0067655 | A1 | 3/2009 | Hanisch et al. | |

FOREIGN PATENT DOCUMENTS

| | | | |
|---|---|---|---|
| DE | 102006049470 | A1 | 7/2008 |
| DE | 102007042591 | A1 | 3/2009 |

* cited by examiner

*Primary Examiner* — Curtis Kuntz
*Assistant Examiner* — Amir Etesam
(74) *Attorney, Agent, or Firm* — Laurence A. Greenberg; Werner H. Stemer; Ralph E. Locher

(57) ABSTRACT

A hearing device that is worn in the ear has a hearing aid and a support device with a runner. The support device remains stationarily inserted in the auditory canal, while the hearing aid is moveably connected to the runner and moveably arranged along the runner. This provides for a hearing device that allows a simple, intuitively understandable modification of the volume and/or sound properties.

4 Claims, 1 Drawing Sheet

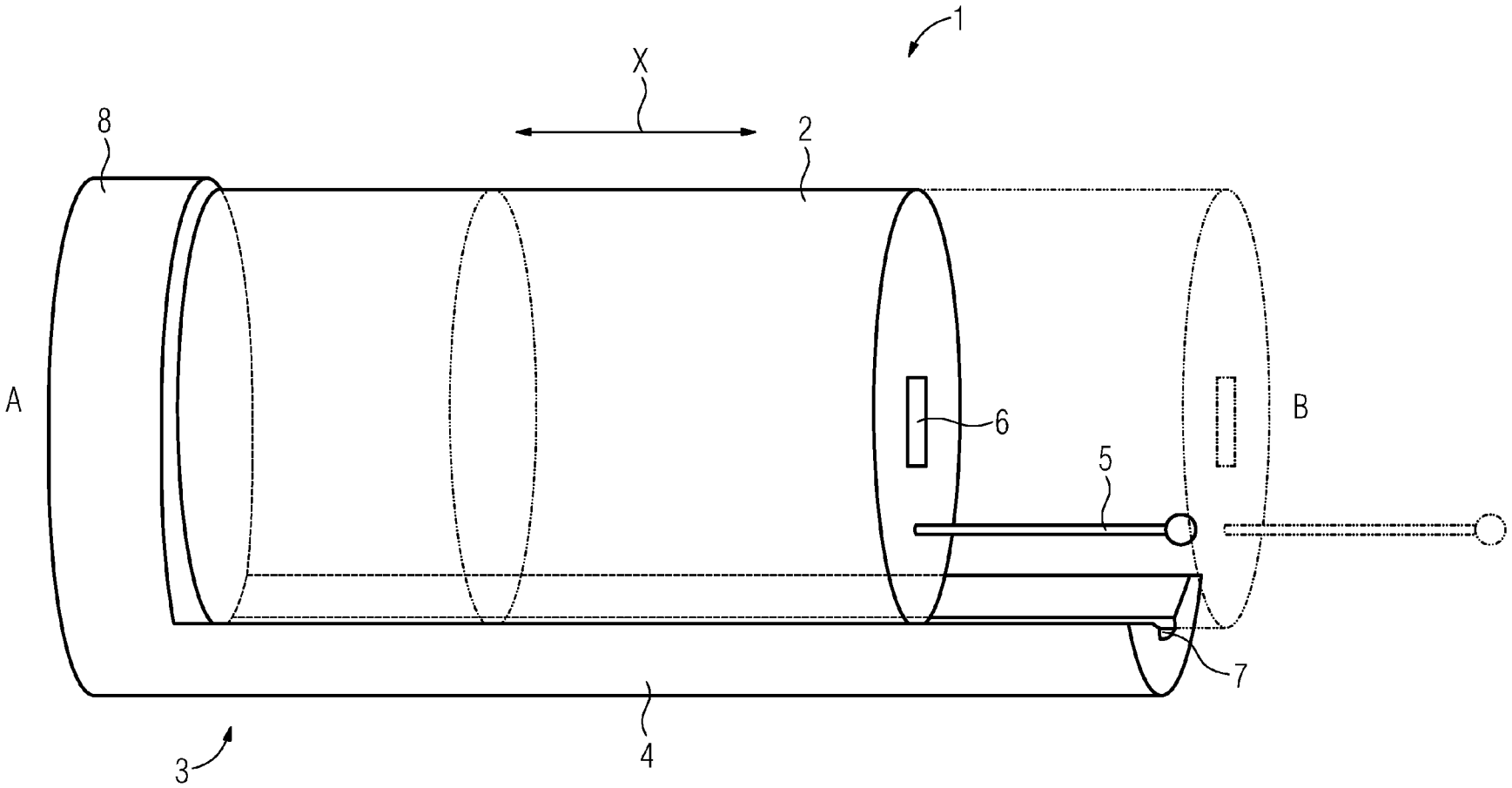
1
2
X
8
A
B
6
5
7
4
3

HEARING DEVICE WITH MECHANICAL ADJUSTMENT OF SOUND PROPERTIES

CROSS-REFERENCE TO RELATED APPLICATION

This application claims the priority, under 35 U.S.C. §119, of German patent application DE 10 2009 057 581.2, filed Dec. 9, 2009; the prior application is herewith incorporated by reference in its entirety.

BACKGROUND OF THE INVENTION

Field of the Invention

The invention relates to a hearing device.

Hearing aid wearers feel the need to adjust the settings of their hearing aids, such as the volume and the sound of the hearing aid, to specific situations. Moreover, hearing aid wearers under certain circumstances suffer from the so-called occlusion effect.

In the case of commercially available hearing aids, the sound and the volume of the hearing aid can be modified by the hearing aid wearer using a remote control that serves to operate the hearing aid, by means of a so-called sound balance where necessary. Furthermore, the volume can additionally be modified directly on the hearing aid if necessary by means of a potentiometer. In the process, the set electronic parameters of the hearing aid electronics are modified in both embodiments.

In practice, modifying the electronic parameters of the hearing aid is often connected with difficulties because the hearing aid wearer often does not understand the effect of the modification of the hearing aid setting, and hence there are erroneous operating actions.

SUMMARY OF THE INVENTION

It is accordingly an object of the invention to provide a hearing device which overcome the above-mentioned disadvantages of the heretofore-known devices and methods of this general type and which provides for a hearing device that allows a simple, intuitively understandable modification of the volume and/or sound properties.

With the foregoing and other objects in view there is provided, in accordance with the invention, a hearing device, comprising:

a hearing aid and a support device configured for insertion into an auditory canal and to be worn in the ear;

the support device is formed with a runner and the hearing aid is moveably connected to the runner and moveably arranged along the runner.

The invention thus allows a mechanical adjustment of volume, sound and occlusion, without needing to modify the set parameters in the hearing aid electronics.

The inventive type of hearing aid adjustment can be understood and comprehended intuitively by the hearing device wearer.

Other features which are considered as characteristic for the invention are set forth in the appended claims.

In accordance with a concomitant feature of the invention, the device further comprises a rod that is mounted to the side of the hearing aid at the entrance to the ear and connected to the hearing aid for moving the hearing aid because it is easy to modify the position of the hearing aid in the ear with respect to the eardrum by using the rod.

Although the invention is illustrated and described herein as embodied in a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE shows a schematic perspective view of a hearing device according to the invention.

DETAILED DESCRIPTION OF THE INVENTION

Referring now to the sole FIGURE of the drawing in detail there is shown a hearing device 1 according to the invention in the form of a so-called in-the-ear (ITE) hearing device. That is, the hearing device 1 is designed to be worn in an ear, more particularly a human ear, and is inserted into the auditory canal and positioned in the auditory canal.

According to the invention, the acoustic properties of the hearing device 1 are modified by mechanical adjustment rather than by electrical adjustment, as is the case in commercially available hearing aids. The hearing device 1 according to the invention has a hearing aid 2 and a support device 3. Within the scope of the exemplary embodiment, the hearing aid 2 contains all electronic components of the hearing device and substantially corresponds to a so-called in-the-ear hearing aid, which is commercially available. Its primarily important components are an input transducer, an amplifier and an output transducer. The input transducer is generally a sound receptor, e.g. a microphone, and/or an electromagnetic receiver, e.g. an induction coil. The output transducer is generally implemented as an electro-acoustic transducer, e.g. as a miniaturized loudspeaker. An acoustic input signal is recorded by the hearing aid 2 using an input transducer—here designed as a microphone 6 in the exemplary embodiment—and the signal is converted into an audio signal, subsequently processed and amplified in the signal-processing unit. Upon processing, the signal is output on the side of the eardrum (i.e., tympanic membrane) by way, for example, of a miniaturized loudspeaker. In the FIGURE, the side of the eardrum is denoted by A and the side of the entrance to the ear is denoted by B.

The support device 3 has an end piece 8 and a runner 4. According to the invention, the hearing aid 2 is moveably connected to the runner 4 and moveably arranged along the runner 4. Within the scope of the exemplary embodiment, the runner 4 has a guide 7 for this purpose. In the illustrated embodiment, the guide 7 is formed as a dovetail guide. When in motion, the hearing aid 2 is guided by the guide 7. Hence, the hearing aid 2 can be moved along the runner 4 with respect to the support device 3. The hearing aid 2 can thereby be displaced in the X-direction with respect to the support device 3.

In general, the support device 3 is inserted that far into the auditory canal in the process that its end piece 8 is arranged in the direct vicinity, or close vicinity, of the eardrum. The hearing aid 2 has in this case been drawn at two different positions in the FIGURE, with it being drawn using solid lines at the first position and using dot-dashed lines at a second position.

If the hearing aid 2 is moved to the first position, i.e. positioned at the end piece 8, it is seated deep in the auditory canal. This results in a loud volume and good sealing of the ear, and very good shielding from noise.

If the hearing aid 2 is moved along the runner 4 in the direction of the B-side end of the runner 4 toward the second position, there is increased aeration of the ear and direct ambient sound from the surroundings of the hearing device wearer passes the hearing aid 2 and reaches the eardrum so the wearer perceives a reduced occlusion effect. Moreover, the perceived volume is reduced and the perceived frequency response is shifted toward high tones because lower frequencies are damped by the aeration and high frequencies reach the eardrum in an increased fashion.

During the movement of the hearing aid 2, the support device 3 does not change its position with respect to the auditory canal and the eardrum.

In order to prevent an undesired change in the position of the hearing aid 2 with respect to the support device 3, for example as a result of the hearing device wearer moving their head, the tolerances of the dovetail guide within the scope of the exemplary embodiment are set such that a certain amount of force is required to overcome the friction holding the device 2 in place and to move the hearing aid 2 along the runner 4. However, alternatively the guide 7 can also be designed to move freely and appropriate friction means can be provided such that there is friction between the hearing aid 2 and the runner 4, and it follows that a certain amount of force needs to be applied in order to move the hearing aid 2 with respect to the runner 4.

In order to allow the hearing device wearer to move the hearing aid 2 with respect to the runner 4 in a simple fashion, a rod 5 is, within the scope of an advantageous development of the invention, arranged on side of the hearing aid at the entrance to the ear and connected to the hearing aid 2. Herein, the length of the rod 5 is dimensioned such that the hearing device wearer can grip the side at the entrance to the ear (B-side end) of the rod 5 from the outside with their fingers, and so the hearing device wearer can, depending on the environment and/or his or her liking, modify the position of the hearing aid 2 with respect to the support device 3, and hence with respect to the position of the eardrum, with the aid of the rod 5. Thus the hearing device wearer can adjust the volume, the sound and the amount of occlusion by way of an intuitively understandable and comprehendible operating action.

At this point, reference is once again made to the fact that the FIGURE shown is a schematic illustration, in which the end piece 8 and the hearing aid are schematically illustrated in the form of cylindrical bodies. In reality, the support device 3, and the end piece 8 and the hearing aid 2 in particular, generally have a geometric shape that has been matched to the individual auditory canal of the hearing device wearer. Also, the support device 3 has exterior walls that are formed of otoplastic so as to fit into the auditory canal and remain stationary therein while the position of the hearing aid 2 is altered by the user.

The invention claimed is:

1. A hearing device, comprising:

a hearing aid and a support device configured for insertion into an auditory canal and to be worn in the ear;

said support device having a runner and said hearing aid being moveably connected to said runner and moveably arranged along said runner while said hearing aid and said support device are inserted in the auditory canal, to thereby change a spacing distance between the hearing aid and the support device to mechanically change the audio properties of the hearing device.

2. The hearing device according to claim 1, which further comprises a rod connected to said hearing aid on a side distally from an eardrum, enabling the hearing aid to be moved relative to said support device by actuation from an entrance to the auditory canal of the ear.

3. The hearing device according to claim 1, wherein said runner is formed with a guide for said hearing aid.

4. The hearing device according to claim 3, wherein said guide and said hearing aid are configured to generate a frictional force opposing a movement of said hearing aid relative to said runner.

* * * * *